US005937073A

United States Patent [19]

Van Gieson

[11] Patent Number: 5,937,073

[45] Date of Patent: Aug. 10, 1999

[54] HANGING, POSITIONABLE, SPEAKER ENCLOSURE

[76] Inventor: David Charles Van Gieson, 910 Calle Angosta, Thousand Oaks, Calif. 91360

[21] Appl. No.: 08/938,827

[22] Filed: Sep. 29, 1997

[51] Int. Cl.[6] ..... H04R 1/02; H04R 9/06

[52] U.S. Cl. ..... 381/391; 381/386; 381/387; 381/152; 181/150

[58] Field of Search ..... 381/340, 152, 381/334, 335, 336, 189, 345, 361, 373, 379, 382, 385, 386, 387, 391, 390, 395, 398, 403, 405, 429, 430, 411; 181/215, 216, 219, 150, 171, 173, 179, 184, 185, 186

[56] References Cited

U.S. PATENT DOCUMENTS

| | | | |
|---|---|---|---|
| 4,101,109 | 7/1978 | Edwards | 248/317 |
| 4,213,008 | 7/1980 | Helffrich | 179/1 E |
| 4,227,669 | 10/1980 | McInnis | 248/317 |
| 4,296,280 | 10/1981 | Richie | 179/1 E |
| 4,417,714 | 11/1983 | Charm | 248/323 |
| 4,660,728 | 4/1987 | Martin | 211/118 |
| 4,974,698 | 12/1990 | Smith | 181/150 |
| 4,993,676 | 2/1991 | Fitts et al. | 248/317 |
| 5,088,574 | 2/1992 | Kertesz, III | 181/150 |
| 5,574,796 | 11/1996 | Keezer | 381/188 |
| 5,657,392 | 8/1997 | Bouchard | 381/90 |
| 5,754,669 | 5/1998 | Shiota | 381/205 |
| 5,828,765 | 5/1996 | Gable | 381/188 |
| 5,832,099 | 1/1997 | Wiener | 381/386 |

*Primary Examiner*—Curtis A. Kuntz
*Assistant Examiner*—Dionne N. Harvey
*Attorney, Agent, or Firm*—Gene Scott-Patent Law & Venture Group

[57] ABSTRACT

The present invention provides a speaker mounted within a speaker enclosure. The speaker enclosure provides a side-wall defining an interior space sufficient for enclosing the speaker, and a grille is mounted on an open end of the speaker enclosure. A pair of electrically conducting wires connect a speaker electrode to an electrical binding post mounted on an enclosing back wall of the speaker enclosure, providing an electrical connection between the speaker and an outside source. A hanger is pivotally engaged with the speaker enclosure such that the speaker enclosure is positionable over a range of downwardly directed angles relative to the hanger. The invention includes a breather hole that provides ventilation between the grille and the interior space of the enclosure. This ventilation allows the speaker to vibrate for maximum sound quality, while also excluding dust from the speaker enclosure. The invention also includes a cable which connects the speaker to an outside structure through a mechanical feed-through such as a pair of mechanical eyes. This direct physical connection between the speaker and an outside source prevents the speaker from falling out of the enclosure and causing damage or injury.

6 Claims, 1 Drawing Sheet

HANGING, POSITIONABLE, SPEAKER ENCLOSURE

BACKGROUND OF THE INVENTION

1. Field of the Invention

This invention relates generally to speakers, and more particularly to a speaker within a speaker enclosure which is suspended overhead and adjustable.

2. Description of Related Art

The following art defines the present state of this field:

Edwards, U.S. Pat. No. 4,101,109 describes a loudspeaker harness for supporting a generally rectangular sectioned loudspeaker having at least four vertical walls and two horizontal walls intersecting at edges to form eight corners. The harness has a pair of longitudinal links passing under bottom wall of housing and extending upwardly adjacent opposed vertical walls, with at least one link cooperating with a support to hang loudspeaker therefrom.

McInnis, U.S. Pat. No. 4,227,669 describes a hanger for suspending sound speakers from a standard ceiling whereby adjustment can be made of the speaker position for best sound dispersal.

Charm, U.S. Pat. No. 4,417,714 describes a stable and highly directable hanging device mounting system for devices such as speaker enclosures that provides 360° of rotation in conjunction with an attitude that is adjustable through 120° or more. The mounting system includes a support plate having three support plate receptacles disposed thereon in a non-collinear relationship. Three device receptacles are adapted to be secured to a device being mounted and distributed about the center of gravity thereof, and a cord threaded alternately through the support plate receptacles and device receptacles to form a plurality of loops supporting the device receptacles to form a plurality of loops supporting the device receptacles and hence the device in a stable hanging relationship relative to the support plate.

Martin, U.S. Pat. No. 4,660,728 describes an apparatus for flying a sound system in which a suspension frame can be winched to a desired height from a roof beam or gantry at a concert venue. The suspension frame has a pair of hanging chains, which are each attached to opposed sides of a loudspeaker cabinet by means of coupling devices. A first webbing loop passes through retaining loops on the rear surfaces of the cabinets and through retaining loops on the rear surfaces of the cabinets and through a tensioning device to ensure that three rear edges are kept in tight contact. A second webbing loop extends from a roof beam or gantry to a lowermost cabinet and includes a second tensioning device. Adjustment of the spacing of the coupling devices on the chaining, the tension applied by the second tensioning device and the position of the connection point on the gantry relative to the chains together contribute to enable various required configurations of the speakers in a flown Fitts et al., U.S. Pat. No. 4,993,676 describes an apparatus for mounting a television set or the like from an ordinary home ceiling that has spaced-apart joists such as two-by-fours placed on edge and a ceiling panel secured to the underside of the joints. The apparatus includes an L-shaped bracket and a hollow shaft connected to one of the legs of the bracket so as to form a U-shaped hook that is engagable in flush contact with a ceiling joist. The shaft extends downward through a hole in the ceiling adjacent to a joist and provides support for a cabinet connected to the shaft. A spacer element is preferably disposed between the cabinet and ceiling, and the cabinet is secured by a disc and nut adjacent to the ceiling and a nut engaging the bottom of the shaft below a support plate connected to the top of the cabinet. Electrical wires and coaxial cables as required are threaded upward through the hollow shaft and are made available for connection to power and signal sources.

The prior art teaches speaker enclosures which can be suspended from the ceiling and are somewhat capable of direction. However, the prior art does not teach a speaker enclosure which is as easily and safely directional as the present invention.

The prior art also does not teach a speaker enclosure providing direct mechanical connection of the speaker to the ceiling. Prior art speakers only fasten the speaker enclosure to the ceiling. Since the magnets of large speakers are very heavy, the speaker would be dangerous if it were to fall out of its housing. Separation of the speaker from its housing is always a possibility because the great vibrations induced by use of the speaker can easily shake any mechanical fastening devices such as screws loose. Since speakers are often positioned over crowds of people, extra safety precautions are highly desirable. Furthermore, a mechanical connection such as a chain could easily be clipped to the ceiling before installation of the speaker housing is attempted, thereby providing an extra safety precaution during installation.

Finally, the prior art does not provide for dust-free ventilation. By providing a breather hole on the underside of the speaker by the grille, air can enter the interior of the speaker enclosure without allowing dust to settle therein. The present invention fulfills these needs and provides further related advantages as described in the following summary.

SUMMARY OF THE INVENTION

The present invention teaches certain benefits in construction and use which give rise to the objectives described below.

The present invention provides a speaker mounted within a speaker enclosure. The speaker enclosure provides a sidewall defining an interior space sufficient for enclosing the speaker, and a grille mounted on an open end of the speaker enclosure. A pair of electrically conducting wires connect a speaker electrode to an electrical binding post mounted on an enclosing back wall of the speaker enclosure, providing an electrical connection between the speaker and an external audio signal source. A hanger is pivotally engaged with the speaker enclosure such that the speaker enclosure is positionable over a range of downwardly directed angles relative to the hanger. The invention includes one or more breather holes that provide ventilation between the grille and the interior space of the enclosure. This ventilation allows the speaker, which is of the cone excursion type, to vibrate for maximum sound quality, while also excluding dust from the speaker enclosure. The invention also includes a structural cable which connects the speaker to an outside structure through a mechanical feed-through such as a pair of mechanical eyes. This direct structural connection between the speaker and an outside source prevents the speaker from falling out of the enclosure and causing damage or injury. This consideration is especially important when the speaker is being installed into the enclosure or replaced.

A primary objective of the present invention is to provide a speaker within a speaker enclosure which is suspended overhead in such a manner as to enable positioning the enclosure for sound direction over a 360 degree angular range.

A further objective is to provide a speaker which is capable of mechanical attachment through the speaker housing to an outside structure such as a ceiling, providing a safety line to prevent the heavy speaker from dropping on anyone in case the speaker falls out of the enclosure.

A final objective of the invention is to provide a breather hole between the speaker enclosure and the grille mounting lip such that air moves freely within the breather hole into and out of the speaker enclosure while dust is generally excluded from the interior of the speaker enclosure.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawing illustrates the present invention. In such drawing.

DETAILED DESCRIPTION OF THE INVENTION

Figure 1:
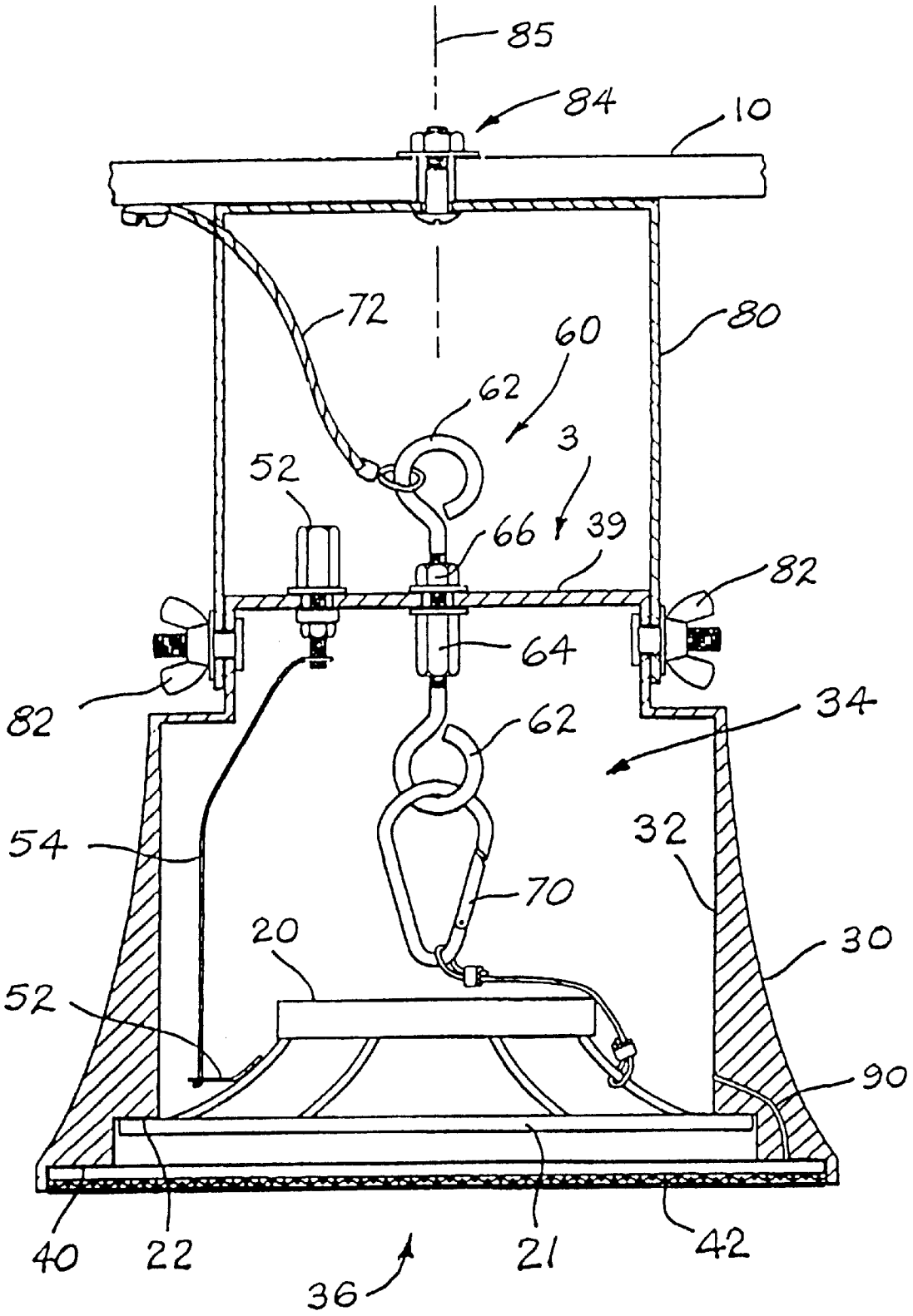
FIG. 1 is a side elevational section view taken on a vertical cutting plane bisecting the invention wherein the sound producing means (loudspeaker device) and various hardware parts are not shown in section for sake of clarity and understanding.

The above described drawing figure illustrates the invention, an enclosed audio device for cooperative mounting to a ceiling structure 10 in a downwardly extending orientation for projecting sound downwardly. The device includes a sound producing means 20, preferably a loudspeaker, mounted within an audio enclosure 30. The enclosure 30 provides a sidewall 32 defining a space 34 within the enclosure sufficient for enclosing the sound producing means 20. At one end of the audio enclosure 30 is an annular grille mounting lip 40 forming an open end 36 of the audio enclosure 30, while at the other end 38 of the enclosure is a solid back wall 39 preferably fully enclosing the enclosure 30 at that other end.

Preferably, a grille means 42 covers the open end 36 of the audio enclosure 30 and is engaged within the grille mounting lip 40 by screws, mounting dogs or other common fasteners (not shown). An annular sound producing means mounting lip 22 is formed adjacent to the grille mounting lip 40. The sound producing means 20 is engaged by its flange 21 within the sound producing means mounting lip 22 by screws, mounting dogs or other common fasteners (not shown).

An electrical feed-through means, such as a common standoff terminal 50, as is well known in the electrical component industry, is mounted on the back wall 39, the electrical feed-through means 50 being electrically interconnected with an electrode means 52 of the sound producing means 20, by an electrical conducting means 54 such as a pair of wire conductors.

A mechanical feed-through means 60, such as a pair of mechanical eyes 62 are mounted in opposing directions within a hexagonal threaded sleeve 64 and having a co-threaded locking nut 66, and are mounted on the back wall 39 such that one of the eyes 62 extends into the interior space 34, while the other of the eyes 62 extend externally away from the back wall 39. The mechanical feed-through means 60 is interconnected with the sound producing means 20 by a flexible structural interconnection means 70 such as the locking hook and steel cable combination shown in FIG. 1. The mechanical feed-through means 60 is also attached to the ceiling structure 10 with a second structural interconnection means 72 such as a steel cable, affording flexibility so that positioning of the audio enclosure means 30 is unrestricted.

A hanger means 80 is pivotally engaged with the audio enclosure means 30 such that the audio enclosure 30 is positionable over a range of downwardly directed angles relative to the hanger means 80. The hanger means 80 further provides a locking means 82, such as the wing nuts shown in the figure, for fixing the audio enclosure means 30 at a selected angle with respect to the vertical. The hanger means 80 further provides a means for mounting 84, such as the bolt and nut shown in the figure so as to fix the hanger means to the ceiling structure 10 so that the hanger means 80 may be positioned at any angle about a vertical axis 85 and so that the audio enclosure may be pointed in any direction over a full 360 angular degrees.

The audio enclosure means 30 further preferably includes a breather hole means 90 placed so as to allow air to move between the space 34 within the audio enclosure means 30 and the open end 36 of the audio enclosure 30. This breather hole means 90 may be a single hole or a series of holes or passages. The breather hole means 90 enables the air within the enclosure to increase and decrease as required by the sound producing means 20 as it moves for the production of sound.

The audio enclosure may be bell shaped as shown in FIG. 1, or may be formed as a straight right cylinder, globular, or other shape as desired.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An enclosed audio device for cooperative mounting to a ceiling structure in a downwardly extending orientation for projecting sound downwardly, the device comprising:

a sound producing means;

an audio enclosure providing a sidewall defining a space therewithin sufficient for enclosing the sound producing means, the sidewall providing at one end thereof an annular grille mounting lip adjacent to an open end of the audio enclosure, and further providing, at the other end thereof, a back wall;

a grille means covering the open end of the audio enclosure and engaged within the grille mounting lip;

an annular sound producing means mounting lip formed adjacent to the grille mounting lip, the sound producing means engaged within the sound producing means mounting lip;

an electrical feed-through means mounted on the back wall, the feed-through means being electrically interconnected with an electrode of the sound producing means by an electrical conducting means;

a mechanical feed-through means mounted on the back wall, the mechanical feed-through means interconnected with the sound producing means by a flexible structural interconnection means;

a hanger means pivotally engaged with the audio enclosure such that the audio enclosure is positionable over a range of downwardly directed angles relative to the hanger means, the hanger means further providing locking means for fixing the audio enclosure at a selected angle within the range of downwardly directed angles, the hanger means further providing means for mounting the hanger means to the ceiling structure so that the hanger means may be positioned at any angle about a vertical axis.

2. The device of claim 1 further including a breather hole means, said breather hole means placed so as to allow air to move between the space within the audio enclosure and the open end of the audio enclosure.

3. The device of claim 1 wherein the speaker enclosure is bell shaped.

4. The device of claim 1 wherein the speaker enclosure is a simple right cylinder.

5. The device of claim 1 wherein the mechanical feedthrough provides an attachment eye adjacent to the enclosing back wall.

6. The device of claim 1 further including a second structural interconnection means for flexible attachment of the enclosure to the ceiling structure so as to enable unrestricted positioning of the enclosure over a 360 degree range of motion while supporting the device during installation.

* * * * *